US007014267B1

(12) United States Patent
Nagar

(10) Patent No.: US 7,014,267 B1
(45) Date of Patent: Mar. 21, 2006

(54) MODULAR FURNITURE SYSTEM

(76) Inventor: Nir Nagar, Flat 7B, 7/F, Block 3, Garden Terrace, 8A Old Peak Rd., Mid-Levels, Central, Hong Kong (HK)

( * ) Notice: Subject to any disclaimer, the term of this patent is extended or adjusted under 35 U.S.C. 154(b) by 0 days.

(21) Appl. No.: 10/950,412

(22) Filed: Sep. 28, 2004

(51) Int. Cl.
*A47C 7/00* (2006.01)

(52) U.S. Cl. ..... 297/440.14

(58) Field of Classification Search ..... 297/440.14, 297/440.1, 217.17, 217.1, 463.2, 118, 129, 297/188.01, 188.11, 188.08, 232, 217.7; 403/171, 172, 381, 375, 231, 295; 312/230, 312/235.2, 235.5, 235.9, 257.1; 211/189; 108/50.11, 50.14, 92, 153.1
See application file for complete search history.

(56) References Cited

U.S. PATENT DOCUMENTS 3,736,035 A * 5/1973 Brown et al. ..... 312/107
3,767,237 A * 10/1973 Suchowski ..... 403/171
4,076,432 A * 2/1978 Glaser ..... 403/176
4,219,958 A * 9/1980 Shulyak ..... 446/487
4,909,547 A * 3/1990 Guy ..... 285/148.28
5,556,218 A * 9/1996 Homer ..... 403/170
5,678,706 A * 10/1997 Husak et al. ..... 211/189
5,688,086 A * 11/1997 Menzemer et al. ..... 410/68
5,904,437 A * 5/1999 Allen ..... 403/170
6,073,942 A * 6/2000 Heneveld, Sr. ..... 280/33.991
6,082,070 A * 7/2000 Jen ..... 52/650.3

* cited by examiner

*Primary Examiner*—Milton Nelson, Jr.
(74) *Attorney, Agent, or Firm*—Dekel Patent Ltd.; David Klein

(57) ABSTRACT

A modular furniture system including a plurality of generally, straight elongate bars, a plurality of connectors for connecting the bars to one another, the connectors including rounded, non-sharp corners and being constructed of an elastomeric material, and a plurality of furniture accessories adapted for connecting to at least one of the bars and connectors.

6 Claims, 6 Drawing Sheets

MODULAR FURNITURE SYSTEM

FIELD OF THE INVENTION

The present invention relates to modular furniture and more particularly to a modular furniture system particularly suited to the needs of children.

BACKGROUND OF THE INVENTION

Modular furniture assemblies are known in the art. Typical known furniture assemblies include modular furniture bases that may be set on a floor and serve as platforms for supporting several different auxiliary components. The modular furniture bases and the auxiliary components couple together to build different assemblies of furniture, e.g., a chair, a sofa, a table and so on.

For example, U.S. Pat. No. 3,811,728 describes a furniture base assembly, which has a rectangular bottom edge for sitting on the floor, a rectangular top surface positioned above the bottom edge, and a four-sided wall interconnecting the top surface with the bottom edge. The top surface is recessed with several criss-crossed slots. The top surface is also recessed along the four sides of its perimeter with slender, rectangular openings. For coupling two such modules together, there are inverted-U shaped clips, with legs having cross-sections in the shape of slender rectangles, for insertion one apiece into the slender, rectangular openings of the top surfaces. Thus two modules can be coupled together to build a modular assembly of a furniture base. Some auxiliary components couple with the furniture base to build chair or sofa assemblies, or table, shelf or bed assemblies.

U.S. Pat. No. 5,452,554 to Santana describes a modular furniture construction system employing a main body element consisting of a longitudinal element as well as two secondary body elements extending transversely from the longitudinal element. Each of the secondary body elements is provided with a key-shaped guiding hole in which a fastening device is inserted adapted to join two main body elements together. These main body elements can be joined together in a number of different ways to form, along with one or more support elements, various pieces of furniture, such as chairs, tables, desks shelves and other similar devices.

U.S. Pat. No. 6,039,501 to Ruther describes modular furniture which includes a frame and an insert plate to be mounted in the frame by corner fittings. Each corner fitting is detachably mounted on the insert plate and comprises at least one laterally accessible receptacle parallel to the plane of the plate for a retaining pin mounted on the frame as well as a locking mechanism for the retaining pin to be arrested in the receptacle.

U.S. Pat. No. 5,423,597 to Rogers describes a modular furniture assembly for children to build and rebuild their own assemblies of school furniture. The assembly components include, as general categories, base components and interchangeable auxiliary components. The auxiliary components can be releasably coupled with the base components to build school-related assemblies including chair assemblies with adjustably high seating surfaces; a notice board assembly for supporting notices or a chalk board or the like; a stage assembly for theatrical productions; symbol display assemblies, as for displaying the alphabet in block letters; and desk assemblies with adjustably high desk tops. In some embodiments of the present invention, the furniture base is not just a unitary component but an assembly of modules. Accordingly, there are modules which can be releasably coupled together to build a modular assembly of a furniture base. The modular base assembly, in turn, can be releasably coupled with several different auxiliary components to build a variety of assemblies including chair assemblies, desk assemblies, drawing board assemblies, sofa assemblies, and bed assemblies.

Some shortcomings of the prior art relate to the safety of the assemblies. For example, prior art assemblies may have sharp corners which may present a hazard to small children.

SUMMARY OF THE INVENTION

The present invention seeks to provide a modular furniture system utilizing a relatively small number of elements to construct various pieces of furniture, such as but not limited to, chairs, work tables, screens, blackboards and the like, by joining the relatively small number of construction pieces together in different manners, as is described in detail further hereinbelow. The present invention addresses the problem of safety and provides rounded corners and soft outer materials to provide maximum safety for even small children.

The present invention has advantages over the prior art due to several features. For example, as far as design and quality are concerned, the materials, dimensions and colors are chosen carefully to fit children's requirements and to have a long service life. The modular system affords unlimited assembly options to fit any space and need. The assembly may be remodeled to match children's growth. The system is washable and user friendly, requiring no screws for assembly.

There is thus provided in accordance with an embodiment of the present invention a modular furniture system including a plurality of generally, straight elongate bars, a plurality of connectors for connecting the bars to one another, the connectors including rounded, non-sharp corners and being constructed of an elastomeric material, and a plurality of furniture accessories adapted for connecting to at least one of the bars and connectors.

The furniture system may include one or more of the following features. For example, each of the connectors may include a six-sided polyhedron body with connector arms extending perpendicularly outwards from the polyhedron body. Each of the connector arms may have one or more peripheral grooves formed therein, and each of the elongate bars may include one or more internal teeth which fixedly sit in the one or more peripheral grooves when the connector arm is inserted in the elongate bar.

In accordance with an embodiment of the present invention, the furniture accessories may include a black board panel, a magnetic panel, a marker board, a mirror board, a basketball board, a compartment for storing recording media, a compartment for storing stationery, a storage box, a set of drawers, a book end, a shelf unit, and/or a cushion or any combination thereof.

BRIEF DESCRIPTION OF THE DRAWINGS

The present invention will be understood and appreciated more fully from the following detailed description taken in conjunction with the drawings in which.

DETAILED DESCRIPTION OF EMBODIMENTS

Figure 1:
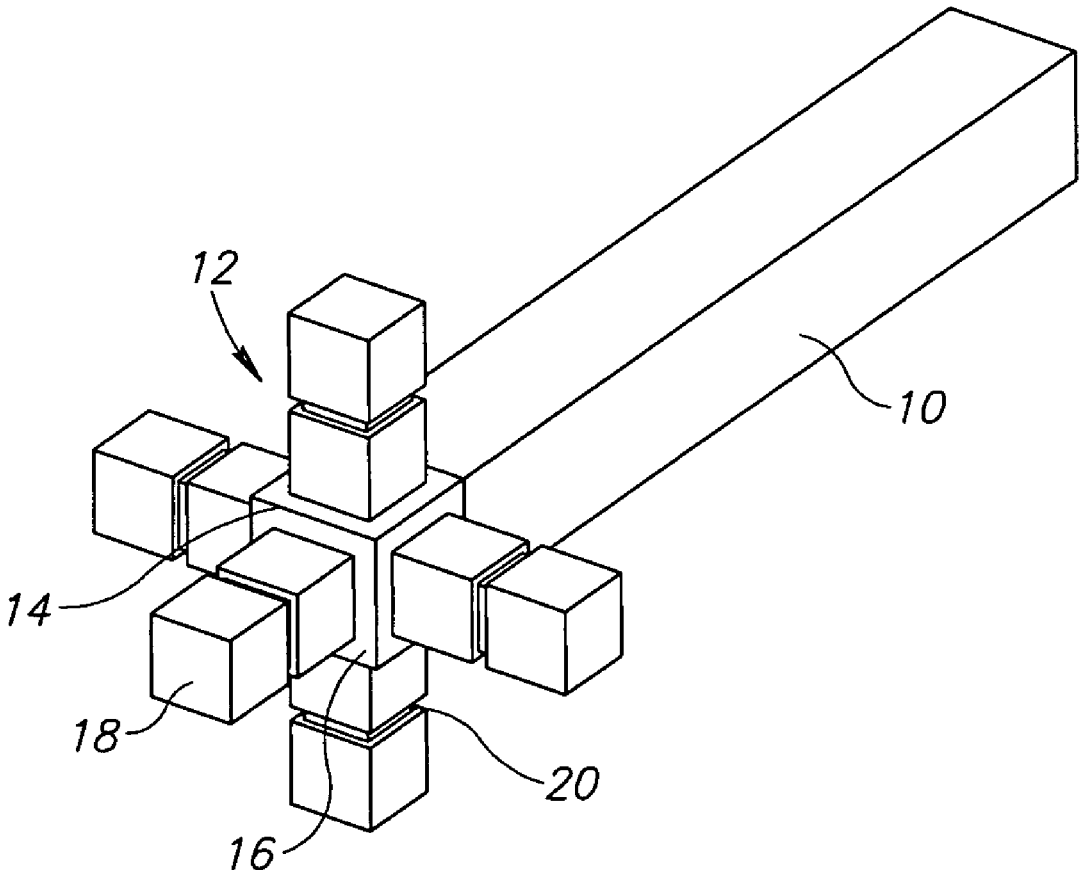
FIG. 1 is a simplified pictorial illustration of an elongate and connector of a modular furniture system, constructed and operative in accordance with an embodiment of the present invention.
Figure 2A:
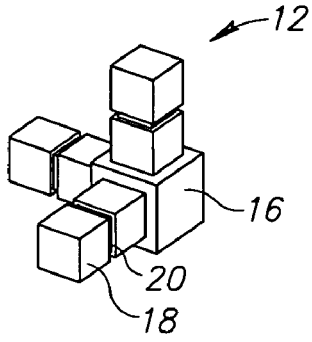
FIGS. 2A, 2B, 2C, 2D, 2E and 2F are simplified pictorial illustrations of different connectors for use with the modular furniture system of the present invention.
Figure 2B:
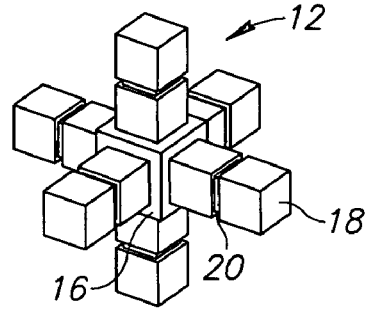
Figure 2C:
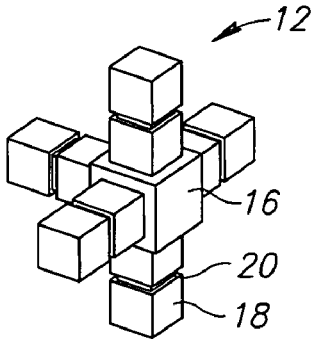
Figure 2D:
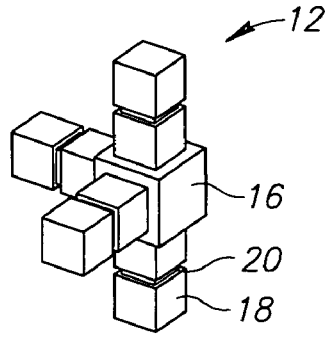
Figure 2E:
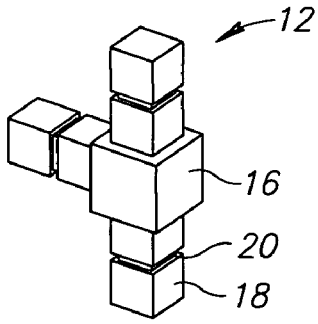
Figure 2F:
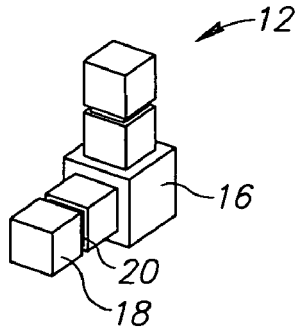

Reference is now made to FIGS. 1, 2A–2F and 3, which illustrate basic construction elements of a modular furniture system, constructed and operative in accordance with an embodiment of the present invention.

The modular furniture system may include a plurality of generally, straight elongate bars 10 and a plurality of connectors 12 for connecting the bars 10 to one another. The bars 10 are illustrated as having a rectangular or square cross sectional shape, but the present invention is not limited to this shape and the bars may be round or have any other arbitrary shape.

The connectors 12 have rounded, non-sharp corners 14 (seen best in FIG. 3) and are constructed of an elastomeric material, such as but not limited to, plastic injection molds of ABS (acrylonitrile butadiene styrene), PP (polypropylene) and/or TPR (thermoplastic rubber or elastomer) polymers. TPR polymer is a polymer blend or compound, which above its melt temperature, exhibits a thermoplastic character that enables it to be shaped into a fabricated article. Accordingly, the modular furniture system of the present invention provides rounded corners and soft outer materials to provide maximum safety for even small children.

Reference is now particularly made to FIGS. 2A–2F, which illustrate various versions of connectors 12. In accordance with a non-limiting embodiment of the present invention, each of the connectors 12 includes a six-sided polyhedron body 16 with connector arms 18 extending perpendicularly outwards from the polyhedron body 16. The six-sided polyhedron body 16 may have equal sides (e.g., cube) or non-equal sides (e.g., prism).

Figure 3:
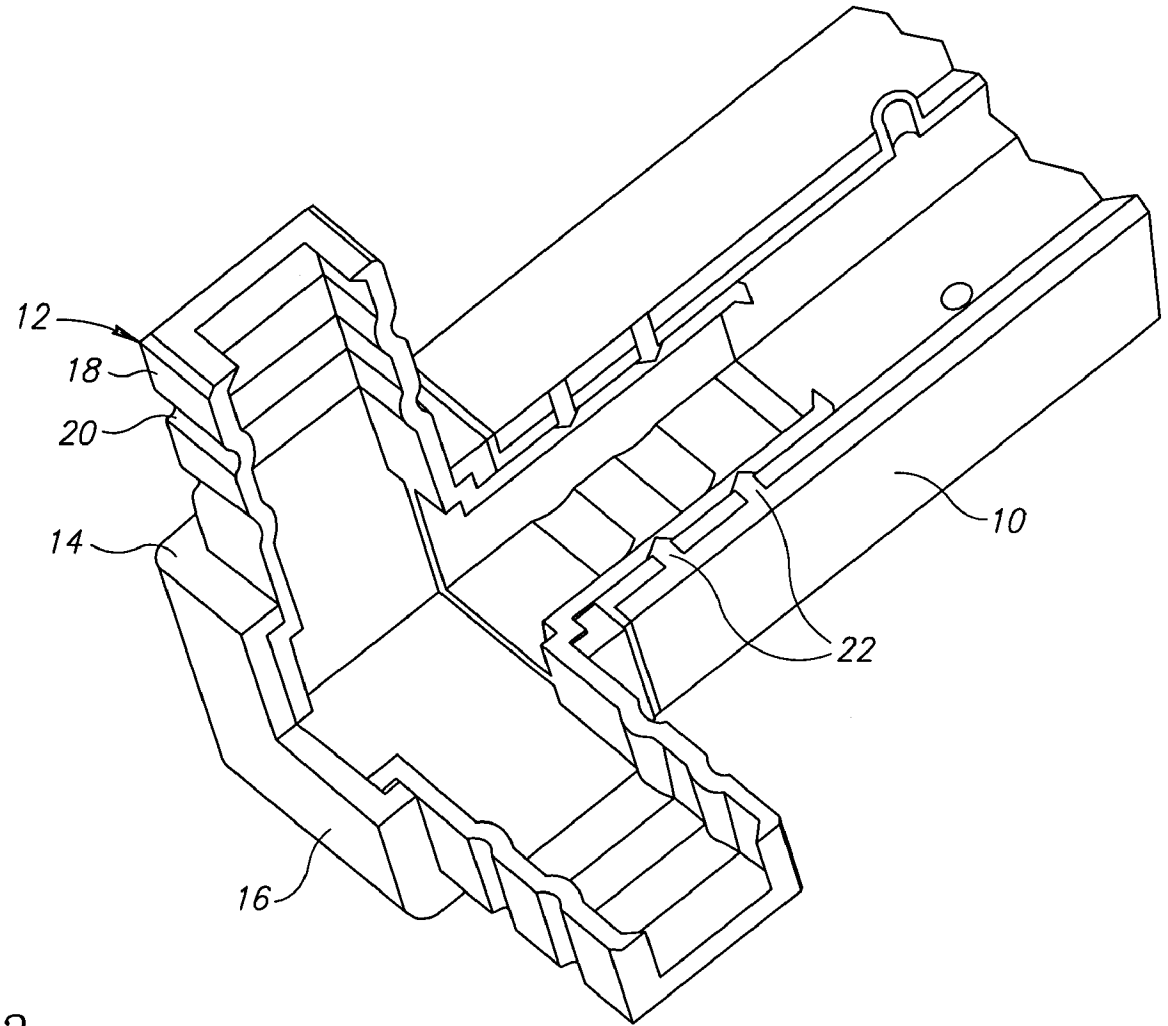
FIG. 3 is a simplified cutaway illustration of the connector inserted in the elongate bar.

The connector arms 18 may have one or more peripheral grooves 20 formed therein. As seen in FIG. 3, the elongate bar 10 may have one or more internal teeth 22 which fixedly sit in the grooves 20 when the connector arm 18 is inserted in the elongate bar 10.

Figure 4:
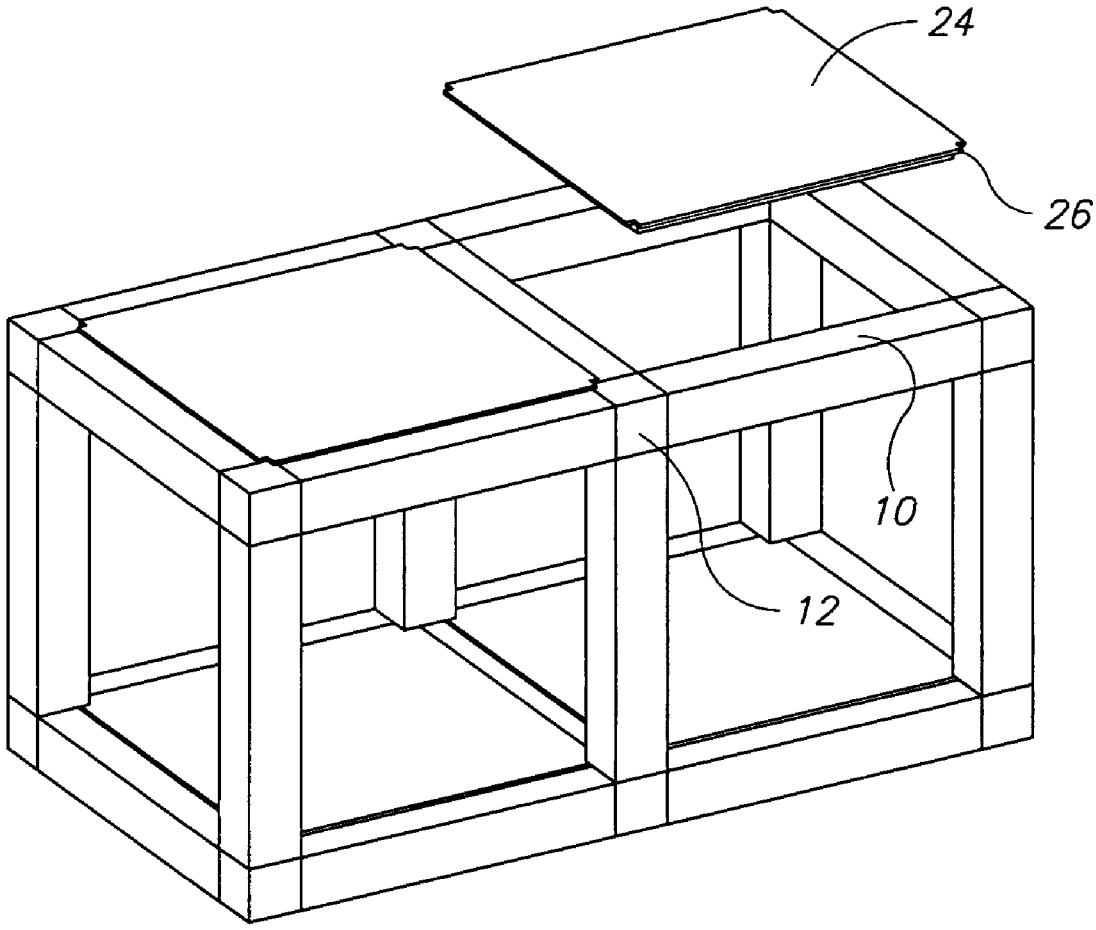
FIG. 4 is a simplified illustration of a furniture accessory being inserted in a partially assembled modular furniture assembly, in accordance with an embodiment of the present invention.

Reference is now made to FIG. 4. A plurality of furniture accessories are provided for connecting to the bars 10 and/or connectors 12. For example, a furniture accessory 24 may comprise a shelf board, which is inserted in a space defined by four bars 10 connected by connectors 12. The shelf board may have a rim 26 that fits over and rests on the bars 10, wherein the rest of the shelf board "clicks" or "snaps" into place.

Figure 5:
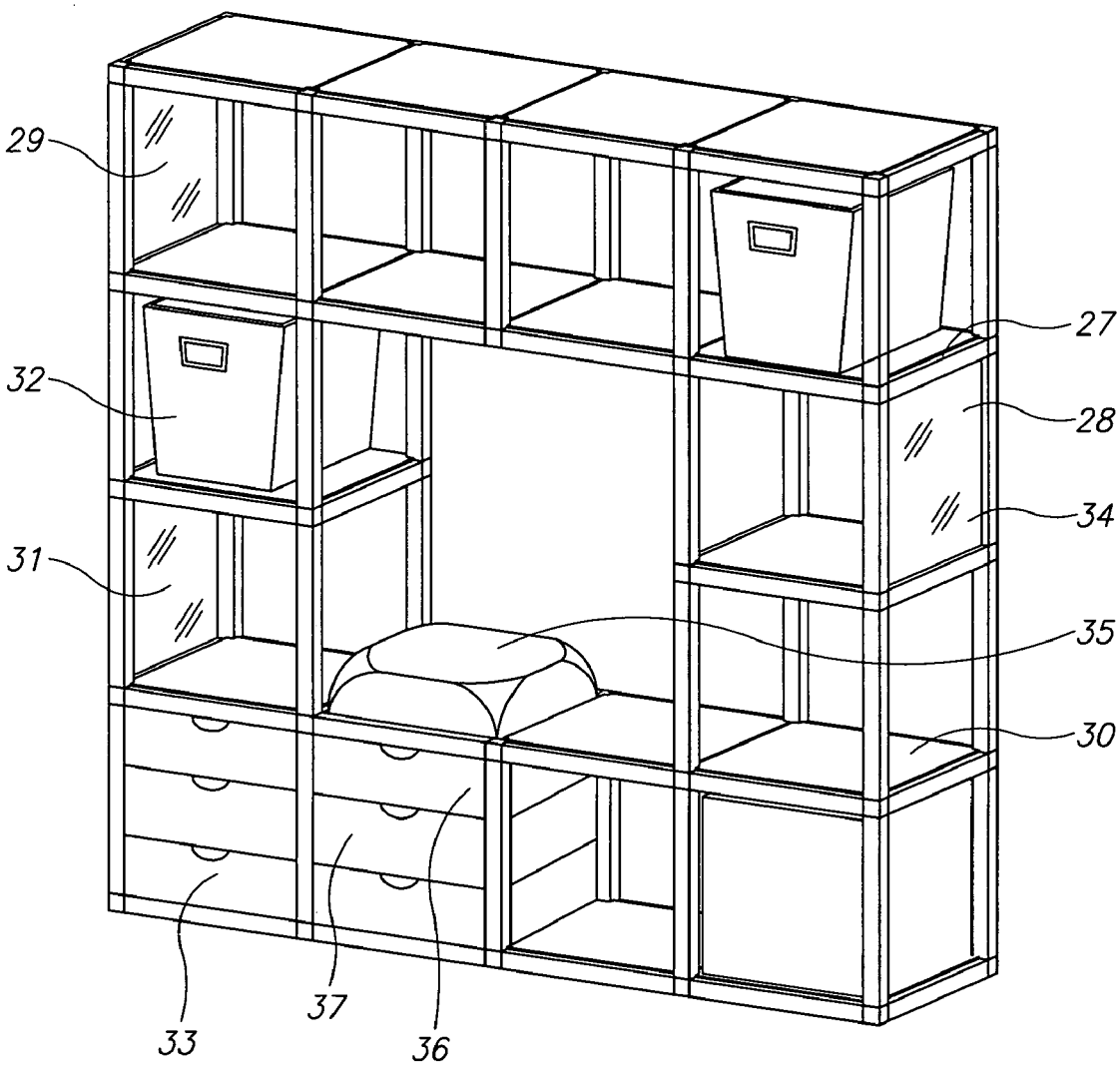
FIGS. 5 and 6 are simplified pictorial illustrations of two examples of modular furniture systems, constructed and operative in accordance with embodiments of the present invention.
Figure 6:
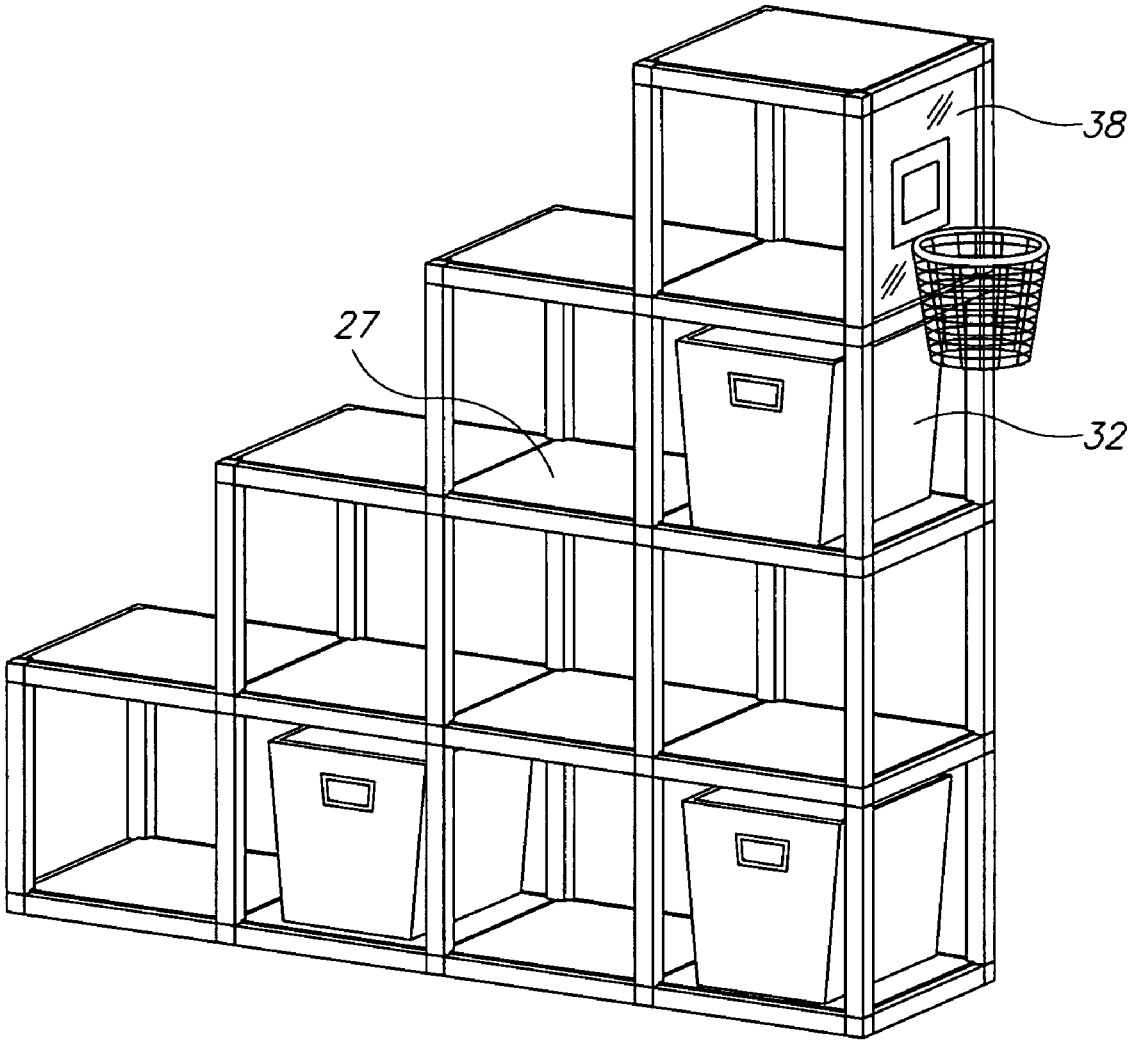

Reference is now made to FIGS. 5 and 6, which illustrate two examples of modular furniture systems, constructed and operative in accordance with embodiments of the present invention.

The modular furniture system of FIG. 5 comprises a set of shelves 27, wherein some of the furniture accessories include a black board panel 28, a magnetic panel 29, a marker board 30, a mirror board 31, a storage box 32, a set of drawers 33, a book end 34, a cushion 35, a compartment for storing recording media 36 and a compartment for storing stationery 37.

The modular furniture system of FIG. 6 comprises a set of shelves 27, wherein some of the furniture accessories include storage boxes 32 and a basketball board 38. It is appreciated that these are just two examples of modular furniture which may be built with the present invention and the invention is not limited to these examples.

It is appreciated that various features of the invention which are, for clarity, described in the contexts of separate embodiments, may also be provided in combination in a single embodiment. Conversely, various features of the invention which are, for brevity, described in the context of a single embodiment, may also be provided separately or in any suitable subcombination.

What is claimed is:

1. A modular furniture system comprising:

a plurality of generally, straight elongate bars;

a plurality of connectors for connecting the bars to one another, said connectors comprising rounded, non-sharp corners and being constructed of an elastomeric material; and a plurality of furniture accessories adapted for connecting to at least one of the bars and connectors, wherein each of said connectors comprises a six-sided polyhedron body with connector arms extending perpendicularly outwards from die polyhedron body, wherein said elastomeric material comprises a thermoplastic rubber polymer.

2. The modular furniture system according to claim 1, wherein said furniture accessories comprise at least one of a black board panel, a magnetic panel, a marker board, a mirror board, a basketball board, a compartment for storing recording media, a compartment for storing stationery, a storage box, a set of drawers, a book end, a shelf unit, and a cushion.

3. The modular furniture system according to claim 1, wherein the six-sided polyhedron body has equal sides.

4. A modular furniture system comprising:

a plurality of generally, straight elongate bars;

a plurality of connectors for connecting the bars to one another, said connectors comprising rounded, non-sharp corners and being constructed of an elastomeric material; and a plurality of furniture accessories adapted for connecting to at least one of the bars and connectors, wherein each connector has at least one peripheral groove formed therein, and each of said elongate bars comprises at least one internal tooth which fixedly sits in said at least one peripheral groove when each connector is inserted in said elongate bar.

5. The modular furniture system according to claim 4, wherein said furniture accessories comprise at least one of a black board panel, a magnetic panel, a marker board, a mirror board, a basketball board, a compartment for storing recording media, a compartment for storing stationery, a storage box, a set of drawers, a book end, a shelf unit, and a cushion.

6. The modular furniture system according to claim 4, wherein said elastomeric material comprises a thermoplastic rubber polymer.

* * * * *